United States Patent [19]

Frangatos et al.

[11] Patent Number: 4,743,387

[45] Date of Patent: May 10, 1988

[54] POLYOXYALKYLENE DIAMIDES AS LUBRICANT ADDITIVES

[75] Inventors: Gerassimos Frangatos, Haddonfield; Robert H. Davis, Pitman, both of N.J.

[73] Assignee: Mobil Oil Corporation, New York, N.Y.

[21] Appl. No.: 691,792

[22] Filed: Jan. 16, 1985

Related U.S. Application Data

[63] Continuation-in-part of Ser. No. 467,527, Feb. 17, 1983, abandoned.

[51] Int. Cl.[4] ..... C10M 133/16

[52] U.S. Cl. ..... 252/51.5 A

[58] Field of Search ..... 252/51.5 A

[56] References Cited

U.S. PATENT DOCUMENTS

| | | | |
|---|---|---|---|
| Re. 30,885 | 3/1982 | Rieder | 252/34 |
| Re. 31,522 | 2/1984 | Rieder | 252/34 |
| 3,806,456 | 4/1974 | Vogel | 252/51.5 A |
| 4,239,635 | 12/1980 | Reider | 252/51.5 A |
| 4,374,741 | 2/1983 | Reider | 252/51.5 A |

*Primary Examiner*—Jacqueline V. Howard

*Attorney, Agent, or Firm*—Alexander J. McKillop

[57] ABSTRACT

Effective demulsifier additives prepared by the reaction of polyalkylenediamines with such carboxylic acids as naphthoic and abietic provide good resistance to water.

4 Claims, No Drawings

POLYOXYALKYLENE DIAMIDES AS LUBRICANT ADDITIVES

CROSS REFERENCE

This is a continuation-in-part of Ser. No. 467,527, filed Feb. 17, 1983 and now abandoned.

BACKGROUND OF THE INVENTION

1. Field of the Invention

This invention is directed to providing effective demulsifier additives having good resistance to water washout prepared by reaction of polyoxyalkylenediamines with carboxylic acids, such as abietic acid and to oil compositions containing same.

2. Discussion of the Prior Art

Much effort has been directed to providing oil systems of improved demulsifying effectiveness, water washout resistance and thermal and oxidative stability in order that the life and effectiveness of lubricating and circulating oils in the presence of these systems are increased, corrosion problems eliminated or reduced in severity and the mechanical failure of machines attributable to the resultant inadequate lubrication avoided.

In most lubricant environments it is highly important that emulsions comprising oil and water be inhibited or if once formed be broken in order that the lubricants may do their intended job. Oil and water emulsions tend to reduce the lubricity characteristics of the lubricant as well as increase the corrosion of metal surfaces with which they come in contact.

It is known that nitrogen containing compounds can act as demulsifiers. See U.S. Pat. No. 4,153,564 wherein a compound comprising the reaction product of an alkenylsuccinic anhydride or acid and an aniline-aldehyde resin or the product of the alkenylsuccinic anhydride and an aromatic triazole are useful demulsifiers. U.S. Pat. No. 4,229,310 relates to phosphorous containing compounds known to have demulsifying properties. However, the instant compounds have not been disclosed or suggested by the prior art as demulsifying agents.

SUMMARY OF THE INVENTION

In accordance with the invention there is provided a lubricant composition comprising a major proportion of an oil of lubricating viscosity or grease prepared therefrom and a minor demulsifying proportion of a product made by reacting a polyoxyalkylenediamine with a carboxylic acid. The lubricant composition may also contain other additives for their known purposes.

DESCRIPTION OF SPECIFIC EMBODIMENTS

Polyoxyalkylenediamines are linear polyethers which have terminal amino groups. The condensation of the amino groups with the carboxylic entities of acids leads primarily to corresponding diamides which act as potent demulsifiers in oil water emulsions. Long polyether chains and bulky three-dimension structures of acids are necessary for the enhanced demulsifying activity attributable to asymmetric solvation and restrained molecular relaxation, of the diamides in accordance with the invention,. A preferred diamide is the condensation product of a polyoxypropylenediamine of average molecular weight of at least about 2000,, e.g., 2000–3000, with abietic acid in a molar ratio of 1 to 2.

Acids having the aforementioned bulky three dimensional structures are highly preferable. Accordingly acids that are cyclic or polycyclic saturates and/or unsaturates are most preferred. Complex structures such as abietic and naphthoic acids are thus highly suited to this invention.

The acids useful in the reaction in accordance with this invention include, but are not limited to abietic, naphthoic, benzoic, dimeric, cholic, cholanic, desoxycholic, glucuronic, galacturonic and mannuronic acids, wool-wax acids and polyalkenyl succinic acids containing from about 7 to about 60 carbon atoms. Especially preferred are those acids selected from the group consisting of abietic, naphthoic, cholic, cholanic, desoxycholic, glucuronic, galacturonic, and mannuronic acids. Most preferred are abietic and naphthoic acids.

The alkylene moiety of the polyoxyalkylene diamines will usually contain from 2 to about 8 carbon atoms. The diamine can be derived from any suitable primary, or secondary amine. Suitable polyoxyalkylenediamines may be obtained readily from commercial sources or prepared in any convenient manner.

In general the carboxylic acid diamide products in accordance with the invention are prepared by reacting from about 2:1 to about 1:2 of carboxylic acid to diamine and the reaction between the carboxylic acids and polyoxyalkylenediamines can be carried out at from about 180° to about 240° C. The temperature of course is selected in accordance with the particular reactants used. Times will vary also, depending upon the reactants, from about 1 hour to about 6 hours, preferably from about 2 to about 4 hours. Solvents may be used if desired to facilitate the reaction When used, the solvent should be removed and therefore should be selected not only for its ability to solubilize the reactants and the product of reaction but also for its ease of separation from the reaction medium. If a solvent is not used, any insolubles can be removed by filtration or any other convenient means. Additionally, the reaction is generally carried out under an inert atmosphere such as nitrogen. Ambient or higher pressures may be used, if desired. The polyoxyalkylenediamines most suited to the invention are those having an average molecular weight of from about 1000 to 3000 with about 2000 being preferred.

The lubricants which may be used with the reaction products of this invention are mineral or synthetic lubricating oils or mixtures thereof and greases prepared therefrom. The mineral oils will be understood to include not only the paraffinic members but also the naphthenic members. By synthetic oils are meant synthetic hydrocarbons, polyalkyleneoxide oils, polyacetals, polysilicones and the like as well as synthetic ester oils. Included among the latter type are those esters made from monohydric alcohols with polycarboxylic acids such as 2-ethyl-hexylazelaic and the like. Also included are those esters made from polyhydric alcohols and aliphatic monocarboxylic acids. Those of this group are especially important and in this group are found esters prepared from (1) the trimethylols, such as the ethane, propane and butane derivatives thereof, (2) 2,2-2,2-disubstituted propane diols and (3) the pentaerythritols reacted with alkylmonocarboxylic acids containing from about 4 to 9 carbon atoms. Mixtures of these acids may be used to prepare the esters, Preferred among the esters are those made from pentaerythritol and a mixture of $C_5$–$C_9$ acids. As has been indicated, the reaction products disclosed herein are useful as demulsifying additives or agents. This utility being connected with oil and water and water and oil emulsions. When so used, they may be added in amounts sufficient to impart such property to the lubricant. More particularly, such properties will be imparted to the lubricant by adding from about 0.01% to about 10% by weight Preferably from about 0.10% to about 3% of the neat product.

Having discussed the invention in broad and general terms, the following are offered to illustrate it. It is to be understood that the examples are merely illustrative and are not intended to limit the scope of the invention. All materials used in the examples were obtained through normal commercial channels unless specified to the contrary.

EXAMPLE 1

Abietic acid (302g, 1 mole) and polyoxypropylenediamine of average molecular weight 2000 (1000g, 0.5 mole) were placed in a flask and heated at 210°-215° C. for four hours with stirring under light flow of nitrogen. The water formed and any volatiles were distilled into a flask throughout the heating period. House vacuum was subsequently applied. The final pot temperature was 215° C. The product—a viscous fluid—weighed 1280gms. The I.R. spectrum of the product shows absorption bands attributable to amide carbonyl groups while the absorption band attributable to carboxylic acid carbonyl groups is absent.

EXAMPLE 2

Polyoxypropylene diamine of average molecular weight 230 (276g 0.13g mole), abietic acid (724.8g 2.41 moles) and xylene (150ml) were placed in a flask and heated to 210°-215° C. while xylene and the water formed were slowly distilled throughout the heating period of four hours. The solvent and any volatiles present were almost completely distilled off. House vacuum was subsequently applied to remove any traces of solvent or any volatiles. The final pot temperature was 215° C. The viscous product solidified as a glass-like material upon cooling. It weighed 974gms.

EXAMPLE 3

Abietic acid (60.4 g, 0.2 mole) and polyoxypropylenediamine of average molecular weight 230 (23 g, 0.1 mole) acid xylene (25 ml) were placed in a flask equipped with nitrogen inlet tube, stirrer and thermometer, reflux condenser and water trap filed with xylene. The mixture was heated at 190° C. for 2 hours under nitrogen with continuous stirring. The initial volume of water (3.6 ml) was collected in the trap. The solvent and any other volatiles were distilled off under reduced pressure. The final pot temperature was 195° C. It weighed 79.4 gms.

EXAMPLE 4

Abietic acid (30.2 g, 0.1 mole) and polyoxypropylenddiamine of average molecular weight 2000 (100 g, 0.05 mole) are placed in a flask and heated at 210° C. for three hours with continuous mechanical stirring under a light stream of nitrogen flowing above the surface of the mixture. The product was a viscous fluid weighing 128 gms. The I.R. spectrum of the product shows absorption bands attributable to amide carbonyl groups the adsorption band attributable to carboxylic acid carbonyls is absent.

Evaluation of Products

Circulating oil formulations using the product of the examples were prepared by blending antioxidants, zinc dithiophosphate antiwear agent, rust inhibitor and demulsifier in highly refined paraffinic oil at 160° F. The following tables summarize the demulsifying capabilities of the product at various concentrations as measured by ASTM D1401 Test for demulsibility of industrial oil.

TABLE 1

| | Base Oil[1] Characteristics Demulsibility Test ASTM D1401 | |
|---|---|---|
| Description of Additive | Demulsifier % Wt | ASTM D1401 Demulsibility Time For Complete Oil/Water Separation, Minutes |
| Base Oil | None | 29 |
| Example 1 | 0.05 | 7 |
| | 0.01 | 15 |
| Example 2 | 0.05 | 16 |
| | 0.01 | 18 |

[1]Circulating oil formulation containing phenolic antioxidants, zinc dithiophosphate and antiwear agent and rust inhibitor in 150" paraffinic oil.

TABLE 2

| | Base Oil[2] Characteristics Demulsibility Test ASTM D1401 | |
|---|---|---|
| Description of Additive | Demulsifier % wt. | ASTM D1401-Demulsibility Time for Complete Oil/Water Separation, Minutes |
| Base Oil | None | 40 |
| Example 3 | 0.05 | 22 |
| Example 4 | 0.05 | 4 |

[2]Circulating Oil formulation containing antioxidants, zinc dithiophosphate, rust inhibitor in a refined paraffinic oil From the data it can be seen that best results are achieved when the diamine has a molecular weight of about 2000-3000 and the molar ratio of said diamine is from about 2 to 1.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

I claim:

1. A non-aqueous lubricant composition possessing improved demulsification protection against the formation of oil and water emulsions comprising a major amount of an oil of lubricating viscosity or grease prepared therefrom and from about 0.01% to about 10% by weight of a polyoxyalkylenediamide prepared by reacting in a molar ratio of from 2 to 1 to about 1 to 2, of a bulky three dimensional carboxylic acid selected from the group consisting of abietic, naphtoic, cholic, cholanic, desoxycholic, glucuronic, galacturonic, and mannuronic acids and a polyoxyalkylenediamine having from about 2 to about 8 carbon atoms in the alkylene portion and a molecular weight of from about 1000 to about 3000

2. The composition of claim 1 wherein the average molecular weight of said diamine is about 2000.

3. The composition of claim 1 wherein the reactants are abietic acid and a polyoxypropylenediamine.

4. The composition of claim 1 wherein the reactants are naphthoic acid and a polyoxypropylenediamine.

* * * * *